US007950467B2

(12) United States Patent
Hansen

(10) Patent No.: US 7,950,467 B2
(45) Date of Patent: May 31, 2011

(54) CONVEYOR TUBE FOR USE IN INSTALLING OR REPLACING A WELL TOOL IN A PRODUCING WELL AND PROCEDURES FOR USE OF THE SAME

(75) Inventor: Henning Hansen, Alicante (ES)

(73) Assignee: Ziebel Group, Tananger (NO)

( * ) Notice: Subject to any disclaimer, the term of this patent is extended or adjusted under 35 U.S.C. 154(b) by 95 days.

(21) Appl. No.: 11/667,004

(22) PCT Filed: Nov. 2, 2005

(86) PCT No.: PCT/GB2005/004207

§ 371 (c)(1),
(2), (4) Date: Oct. 19, 2007

(87) PCT Pub. No.: WO2006/048623

PCT Pub. Date: May 11, 2006

(65) Prior Publication Data

US 2008/0110677 A1 May 15, 2008

(30) Foreign Application Priority Data

Nov. 3, 2004 (NO) ..... 20044756

(51) Int. Cl.
*E21B 19/16* (2006.01)

(52) U.S. Cl. ..... 166/380; 166/242.5; 166/169

(58) Field of Classification Search ..... 166/380, 166/385, 386, 169, 242.5, 242.3
See application file for complete search history.

(56) References Cited

U.S. PATENT DOCUMENTS

| | | | | |
|---|---|---|---|---|
| 4,574,883 | A * | 3/1986 | Carroll et al. | 166/255.1 |
| 4,940,094 | A | 7/1990 | Lessi et al. | |
| 5,058,670 | A * | 10/1991 | Crawford et al. | 166/117.6 |
| 5,927,405 | A | 7/1999 | Monjure et al. | |
| 6,230,812 | B1 | 5/2001 | Reaux | |
| 2002/0007948 | A1 * | 1/2002 | Bayne et al. | 166/278 |
| 2005/0279510 | A1 * | 12/2005 | Patel et al. | 166/380 |

FOREIGN PATENT DOCUMENTS

| | | | |
|---|---|---|---|
| CA | 2 339 715 | A1 | 9/2002 |
| WO | WO 2004/066000 | A2 | 8/2004 |

* cited by examiner

*Primary Examiner* — Daniel P Stephenson
(74) *Attorney, Agent, or Firm* — Sughrue Mion, PLLC

(57) ABSTRACT

This invention describes a conveyor tube for use in installing or replacing a well tool in a producing well, wherein the well tool is fed into the conveyor tube which at least runs between a valve tree and at least one receiving unit in the well, and wherein the conveyor tube is installed on the outside of and in fluid communication with a production tube in the well. A method for using same is also described.

24 Claims, 5 Drawing Sheets

CONVEYOR TUBE FOR USE IN INSTALLING OR REPLACING A WELL TOOL IN A PRODUCING WELL AND PROCEDURES FOR USE OF THE SAME

BACKGROUND OF THE INVENTION

This invention relates to a conveyor tube for use in installing or replacing a well tool in a producing well. More specifically it is a conveyor tube which runs along the outside of the production tube of the producing well, wherein the conveyor tube is designed to be able to move well tools, which may be for example, but are not limited to, sensors for sensing well parameters and/or flow directors for guiding circulation in sections of the production tube, to a predetermined position. The invention also relates to procedures for using it.

The object of the invention is to provide a device and method for installing and replacing well tools in a producing well without the need for complicated and demanding well completion work.

In the petroleum industry it is desirable, for economic reasons among others, to maintain production to the maximum possible degree.

It is also necessary to conduct measurements of parameters in the well that are important for controlling production, calculating the present reservoir fluid, drainage efficiency and so on. To sense the desired parameters it is now normal practice to install sensors permanently in wells. The sensors communicate through cables laid through the valve tree of the well to a surface installation from which the well is monitored and controlled.

The well environment has been shown to have a degrading effect on the sensors used due, among other things, to the harsh environment that frequently prevails in a well. The failure of sensors after being installed in wells is therefore felt to be a problem. In order to replace a sensor that has failed the entire well completion must be pulled to the surface to provide access to the sensor. When this takes place the well must be protected against leakage, and barriers must be fitted against the reservoir. Such barriers result in stoppage of production whilst the replacement operation is being carried, resulting in economic loss.

To reduce some of the disadvantages of the above-mentioned method of prior art attempts have been made to develop procedures for carrying out an intervention in a well to replace a damaged measuring instrument that has been installed in a so-called side pocket ("side pocket mandrel"). In this case a tool is inserted which pulls out the measuring instrument installed in a pocket in the production tube. A new intervention (operation) is then carried out to insert a new measuring instrument. This is done by means of a cable ("wireline") or coiled tubing.

One major drawback of this procedure is that an expensive electrical or fibre optic coupling must be used which is connected in the "wet" condition in the well fluid. This coupling has proved to be unreliable and the procedure is therefore little used in the petroleum industry.

In the petroleum industry it is also necessary to pump different types of auxiliary tools into the well production tube. After this, the pumped-in auxiliary tool must be circulated until it reaches the desired position in the well. In this specialist field this is called TFL ("Through Flow Line") or Pump Down Tools, and it is based on running an insert line parallel with the production tube, and has the same diameter as it. The two tubes mentioned are connected at a circulation point in the well, the circulation point being installed as far down in the well as possible, normally just above the production packing. A major disadvantage of the TFL technology of prior art is that the possibility of circulation is lost if the production tube is blocked above the circulation point.

American patent U.S. Pat. No. 4,940,094 shows a procedure and a device for operating a circulating valve down in a well using TFL technology, as described above, wherein production takes place through the insert line through which the device is fed to operate the aforementioned circulating valve.

The object of the invention is to obviate or at least reduce one or more disadvantages of the method of prior art.

SUMMARY OF THE INVENTION

This invention comprises a conveyor tube for use when installing or replacing a well tool in a producing well, wherein the well tool is fed in the conveyor tube which at least runs between a valve tree and at least one receiving unit in the well, the conveyor being installed on the outside of a production tube in the well. The conveyor tube may consist, for example, but are not limited to, tubes screwed together or coiled tubes, which are preferably installed at the same time as the well completion. In a preferred design the well is provided with two or more receiving units, which are installed so that they connect to fluid connection ducts which create a fluid connection between the inside of the conveyor tube and the inside of the production tube. When a certain well tool approaches a predetermined receiving unit the well tool and the receiving unit are designed to engage with each other so that the well tool mentioned is blocked from further movement in the receiving unit. In a preferred design at least one receiving unit is provided with a unique locking profile which is designed to engage with an approaching well tool which is provided with a locking profile which is complementary to the unique locking tool mentioned. A well tool may therefore be fed down through the conveyor tube and pass through one or more non-complementary locking profiles before it finally, and preferably, locks into a receiving unit.

In a preferred design the well tool is arranged to be pumped down through the conveyor tube by a known method using a fluid which is pumped by means of a pump device and packing system installed on the valve tree, for example. In an alternative design the well tool is arranged for lowering into the conveyor tube, where the well tool is attached to a wire or control cable which may be, for example, but is not limited to, an electric cable, a fibre optic cable or a combination of these.

The well tool is released from the lock in the receiving unit and is moved up through the conveyor tube under the influence of fluid pressure or, in cases where wires or a control cable are used, when the wire or control cable is pulled against the surface.

In a first embodiment of the invention the conveyor tube is designed to receive one or more sensors designed for sensing one or more well parameters, in one or more receiving units. At least one sensor senses the current well parameter or parameters from the well fluid present at any time in the fluid connection duct between the production tube and conveyor tube. In one design the sensor is held in position in the receiving unit by the differential pressure between the conveyor tube and the production tube. In this design there is no need for the sensor to be provided with a locking device that keeps the sensor steady in relation to the receiving unit. In a preferred design the sensor is provided with a locking device which engages with a complementary locking device in the receiving unit mentioned, as previously described.

In a second embodiment of the invention the conveyor tube is designed to receive one or more flow correctors in the receiving unit to which the conveyor tube is connected. The flow corrector is designed to engage with the locking device of a predetermined receiving unit. In one design the flow corrector is designed to conduct a fluid flow in the conveyor tube down through the conveyor tube. In another design the flow corrector is designed to conduct the fluid flow in the conveyor tube out through the fluid connection duct, which opens to the fluid connection between the conveyor tube and the production tube. In a further design the flow corrector is designed to conduct the fluid flow in the conveyor tube both down through the conveyor tube and out through the aforementioned fluid connection duct. In yet a further design the flow corrector is designed to block all further flow.

In a third embodiment of the invention the conveyor tube is designed to receive both one or more sensors and one or more flow correctors.

BRIEF DESCRIPTION OF THE DRAWINGS

Non-limiting examples of preferred designs illustrated on the accompanying drawings are described in the following, and in these drawings.

DETAILED DESCRIPTION OF THE DRAWINGS

The same or corresponding components are designated by the same reference numbers in the figures.

Some of the figures show a valve tree 20 of the vertical type, provided with valves of a known type which are known in the specialist field as "hydraulic master valve" 22, a "master valve" 24, a "swab valve" 26 and a side valve 28, through which the production fluids in the well flow on out to a tube arrangement not shown. The valve tree 20 is provided in an upper end section with a top cover 30, to which is secured a pressure gauge 31. An expert in the field will be aware of the function of valve tree 20, and for this reason it will not be described in more detail.

Figure 1:
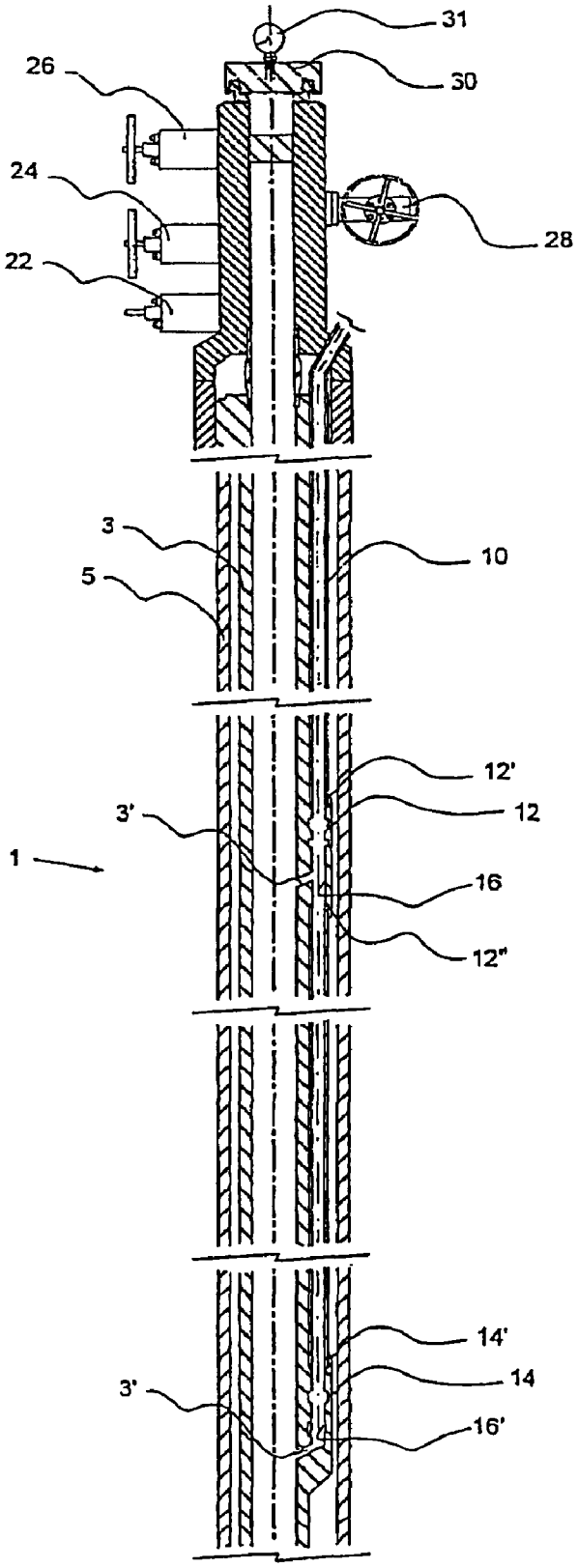
FIG. 1 shows a conveyor tube according to this invention, where the conveyor tube projects from a valve tree to the bottom of a well. The conveyor tube is installed in the annular space between a production tube and a production casing, and is in fluid connection with two receiving units.

In FIG. 1 the reference number 1 designates a section of a well consisting of a production tube 3 and a feeds tube 5. In the annular space between production tube 3 and feed tube 5 is installed a conveyor tube 10, which projects from a valve tree 20 down into well 1 via a first receiving unit 12, which is provided with a through hole 16, and down to a second receiving unit 14, in which conveyor tube 10 has its lower end connection point 14'. Conveyor tube 10 is connected to the first receiving unit 12 in an upper connection point 12' and a lower connection point 12". The connection between conveyor tube 10 and receiving units 12, 14 can be made, for example, by means of a screw connection or welded joint. The second receiving unit is provided with a non-through hole 16', which is in fluid communication with a side hole 16" made in the receiving unit.

Although only two receiving units 12, 14 are shown in the figure, it must be understood that conveyor tube 10 can be connected to any number of receiving units. Receiving units 12, 14 are shown in the design examples as integrated with production unit 3. In alternative designs (not shown) the receiving units can be secured to a section of production tube 3.

When reference is made in the following to conveyor tube 10, this is also interpreted as including receiving units 12, 14, since in the operating situation they constitute a section of conveyor tube 10.

Production tube 3 is provided with holes which in turn provide fluid connection ducts 3' between production tube 3 and holes 16, 16' in receiving units 12, 14. Each receiving element 12, 14 is shown in FIG. 1 as being provided with one fluid connection duct 3'. In an alternative design (not shown) production tube 3 may be provided with two or more holes 3', which in turn provide a fluid connection between production tube 3 and each of receiving units 12, 14 of conveyor tube 10.

Figure 2:
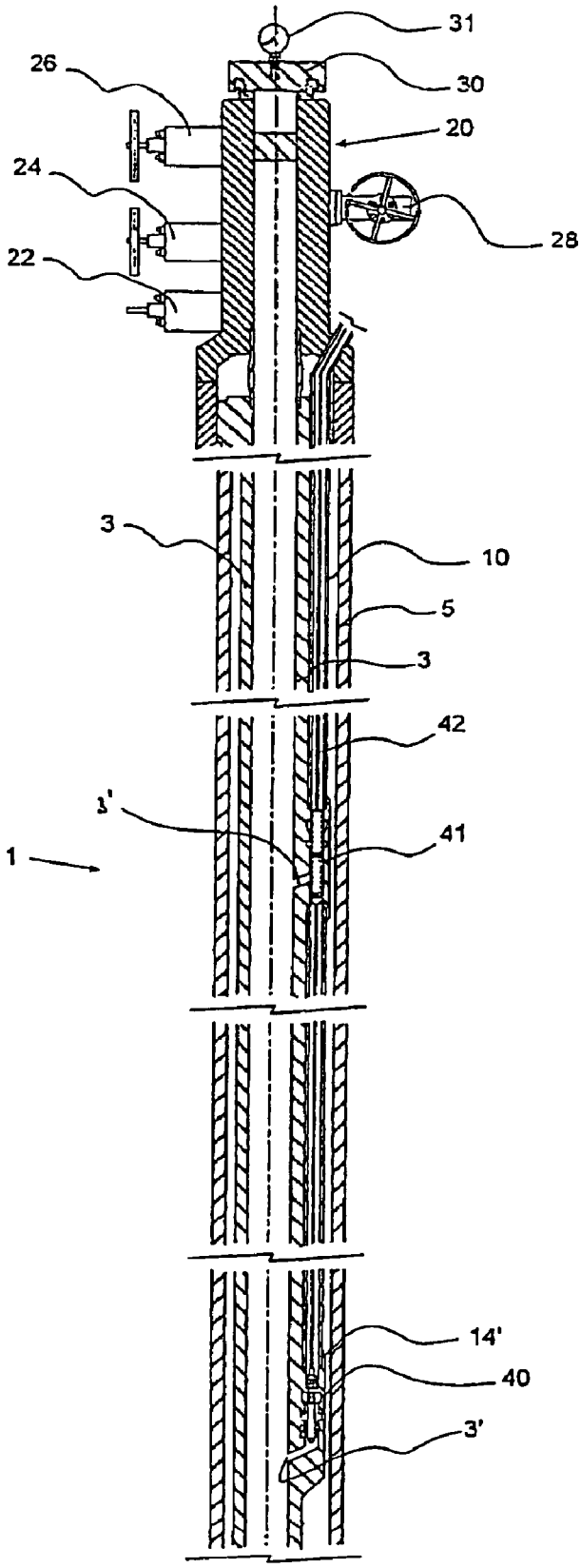
FIG. 2 shows the arrangement in FIG. 1 after a sensor has been fed through a first receiving unit and on down through the conveyor tube and into a second receiving unit. A flow corrector has been fitted in the first receiving unit.
Figure 4:
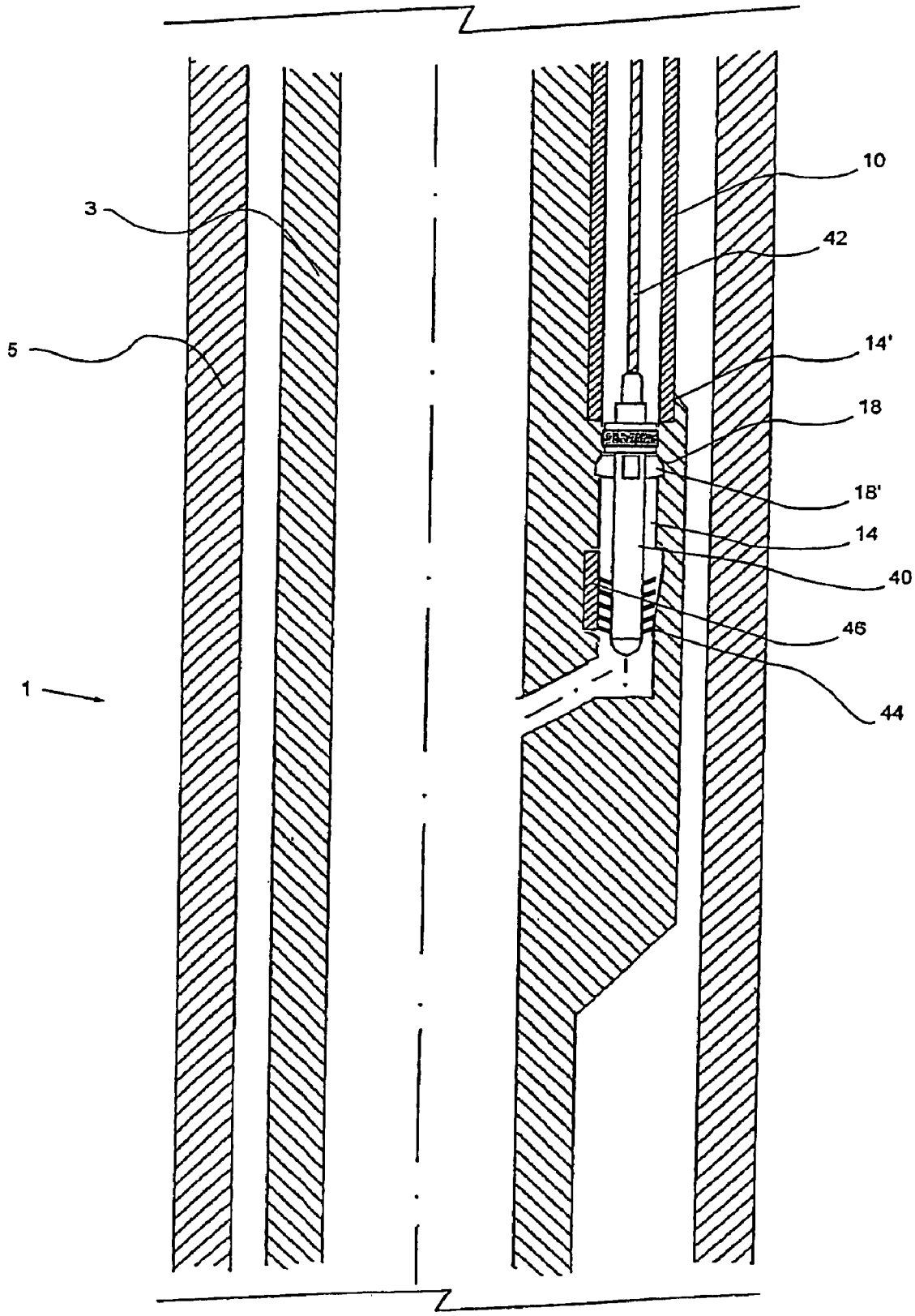
FIG. 4 shows, on a larger scale, a section of the sensor in FIG. 2, which has been installed in a second receiving unit.
Figure 5:
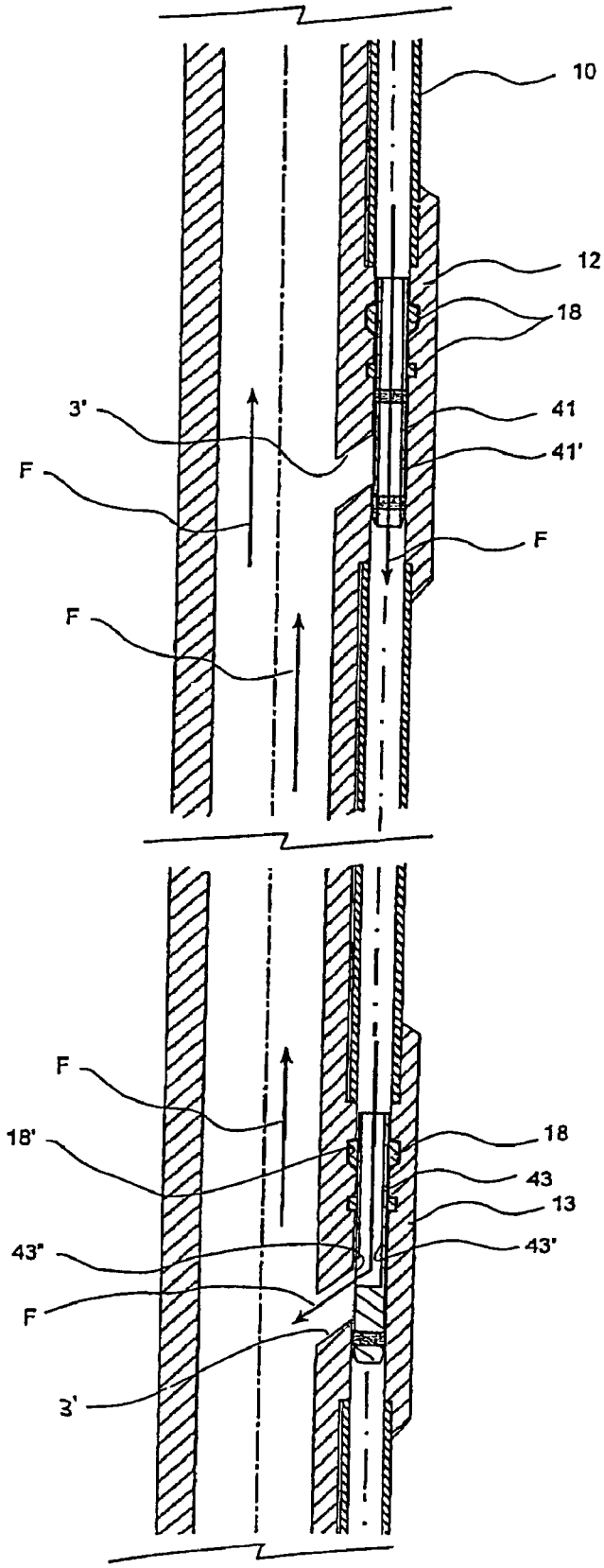
FIG. 5 shows, on a smaller scale, a section of a well in which two different types of flow correctors have been fed down through the conveyor tube in the well and which have been installed in their own receiving units.

Each of receiving units 12, 14 of conveyor tube 10 are provided with a unique locking profile 18, see FIG. 4, which is designed to receive a well tool 40, see FIG. 2, which is provided with a locking element 18' complementary to the aforementioned unique locking profile 18, which element can best be seen in FIG. 4 and FIG. 5. Locking element 18' of well tool 40 is arranged, in a preferred design, to be able to pass through a non-complementary locking profile 18 in receiving units 12, and is fed on through the conveyor tube to the next receiving unit 14, as shown in FIG. 2, where the well tool consists of a sensor 40 which is installed in receiving unit 14 and which communicates with the surface via a sensor cable 42. Fluid connection duct 3' to upper receiving unit 12 is blocked by a well tool comprising a flow corrector 41, which will be described in more detail later.

Well tool 40 can be lowered down into a well 1 by gravity. In wells with a deviation (not shown) relative to the vertical plane it may be difficult or impossible to feed a well tool 40 along conveyor tube 3 solely on the basis of gravity. An intrinsically known method that is difficult to use to convey well tools in tubes involves using a fluid flow which is brought about by a pumping device (not shown).

Figure 3:
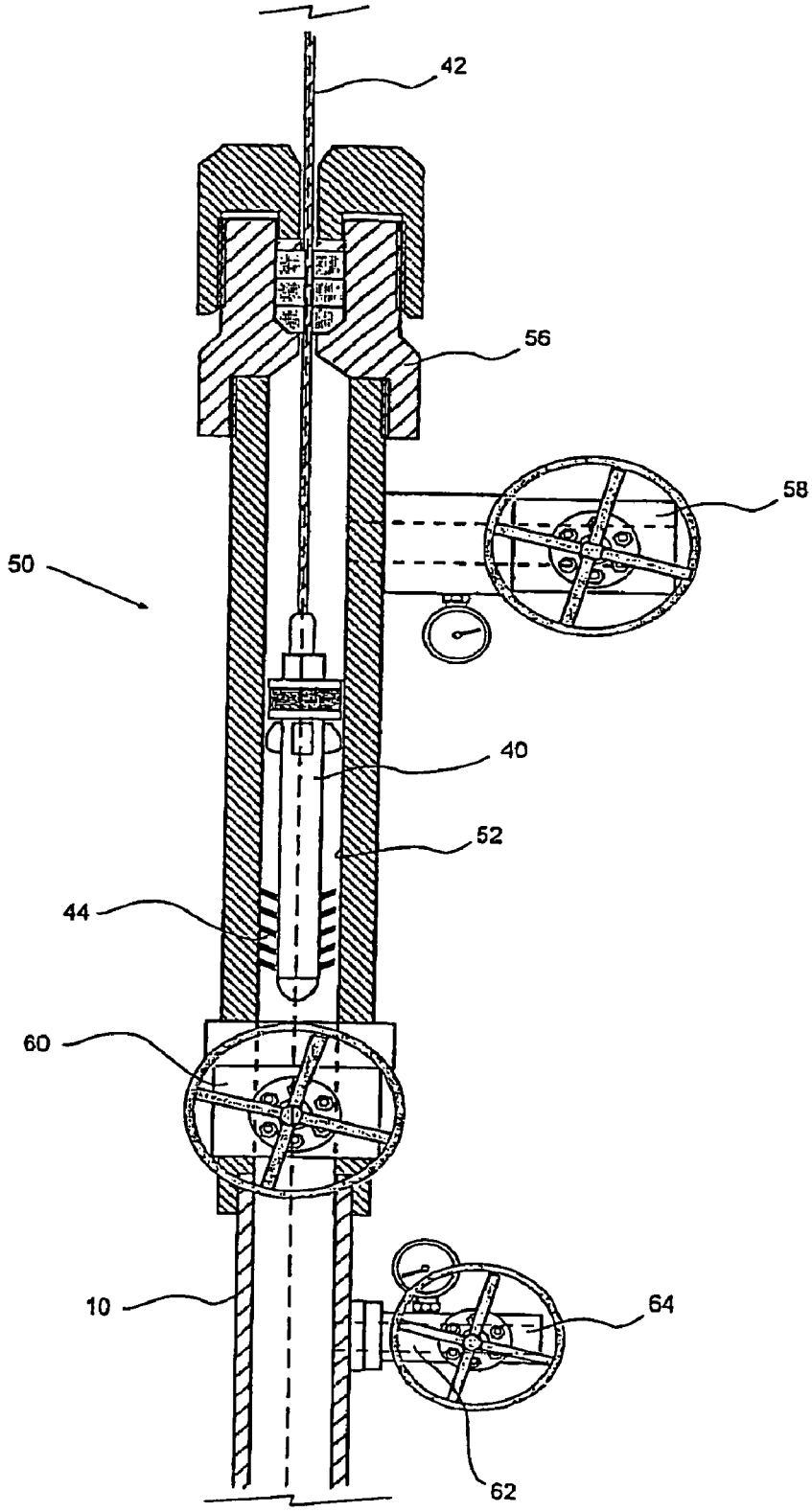
FIG. 3 shows, on a larger scale, an explanatory sketch of a device for introducing a sensor in an upper section of the conveyor tube. This device is fitted at the outlet of the conveyor tube, which opens up into an available area near the valve tree.

FIG. 3 shows the upper end section of conveyor tube 10, see FIGS. 1 and 2, connected to a known introducing arrangement SO, where well tool in the form of a sensor is introduced into a sluice chamber 52. In the specialist field such a sluice chamber is often referred to as a "lubricator". Cable 42 of sensor 40 is fed through a sealing arrangement 54 in an upper end section of sluice chamber 52. The sealing arrangement consists of a sealing housing 56, which in the specialist field is known as a "stuffing box", and packings and tightening devices of known type, which are shown in the drawings but which will not be described further. Fluid, for example a liquid, is pumped into sluice chamber 52 via a valve 58, which fluid will drive sensor 40 into conveyor tube 10 and on down through it by a known method. FIG. 3 also shows a valve 60 for isolating conveyor tube 3 and an outlet tube 62, with outlet valve 64 for pressure control and monitoring of conveyor tube 10.

The device shown in FIG. 3 may in principle also be used for pumping in a cable-free flow regulator. However, the sealing housing, the so-called "stuffing box", must in this case be replaced with a tight end plug of a known type.

Sensor 40, shown in FIG. 3, is provided in its free end section with a plurality of circular elastic elements 44 designed to be supported against the inner wall of sluice chamber 52 and conveyor tube 10, so that as much of the fluid as possible which is pumped into sluice chamber 52 and on into conveyor tube 10 drives sensor 40 down into conveyor tube 10 until sensor 40 engages with a predetermined receiving unit 12, 14, see FIG. 1.

FIG. 4 shows a section of FIG. 2 on a larger scale, in which sensor 40, shown in outline, has been installed in the second receiving unit 14, and where locking element 18' of sensor 40 engages with the complementary locking profile 18 of receiving unit 14. A closing valve 46 of a known type, fitted in receiving unit 14, is rotated by sensor 40 to the open position. In a preferred design closing valve 46 is provided with a pre-tensioning device such as an intrinsically known spring device (not shown). The purpose of closing valve 46 is to prevent production fluids from being forced up through conveyor tube 10 when sensor 40 is withdrawn from receiving unit 14, and closing valve 46 of the pre-tensioning device is rotated and blocks fluid flow through hole 16' and on up through conveyor 10, since it will not normally be produced through conveyor tube 10.

FIG. 5 shows a first flow corrector 41 installed in a receiving unit 12, and a second flow corrector 43 installed in a receiving unit 13 at the bottom. As shown in FIG. 5, first flow corrector 41, aforementioned, is provided with an essentially central through hole 41' which, when locking element 18' of flow corrector 41 engages with locking profile 18 of receiving unit 12, conducts fluid flow F past fluid connection duct 3' and on down through conveyor tube 10. Second flow corrector 43 is provided with an essentially central blind hole 43', which communicates with a side hole 43". When locking element 18' of flow corrector 43 engages with locking profile 18 of receiving unit, fluid flow F is fed out through fluid connection duct 3'. Fluid flow F is prevented by the undrilled end section of flow corrector 434 from flowing on down through conveyor tube 10.

Well tools 40, 41, 43 are disengaged from receiving units 12, 14 by a known method, for example by, but not limited to, carrying out repeated pressure settings and bleeding of the conveyor tube, or by using mechanical devices, e.g. setting/pulling tools (not shown) designed to release locking elements 18' from engagement with locking profiles 18. This is well known to an expert in the field, and will not be described in greater detail.

By feeding flow correctors 41, 43 down through a well 1 to the desired location or locations, tools may be circulated up and/or down into conveyor tube 10 and production tube 3, even though there is a plug, or other barrier fitted over the lowest circulation point. This affords major advantages compared to the prior art, which only has one circulation point in a well.

The invention claimed is:

1. A producing well comprising:

a conveyor tube for use in installing or replacing a well tool, a production tube, wherein the conveyor tube is installed on the outside of a production tube in a well, and wherein the well tool is fed into the conveyor tube, and a valve tree provided at a top of the well, the conveyor tube comprising at least one receiving unit in the well, the at least one receiving unit being configured such that the well tool pumped into the conveyor tube can be engaged into the at least one receiving unit, and at least a section of the conveyor tube runs between the valve tree and the at least one receiving unit in the well.

2. The well according to claim 1, wherein the inside of the conveyor tube is in fluid communication with the inside of the production tube by means of at least one fluid connection duct fitted so that it connects to each of at least one receiving unit.

3. The well according to claim 1, wherein the conveyor tube is designed to block the well tool from further movement in the conveyor tube when the well tool is in a predetermined position.

4. The well according to claim 3, wherein the predetermined position is in at least one of the receiving units.

5. The well according to claim 3 wherein each of the at least one of the receiving units is provided with a unique locking profile which is designed to receive a well tool with a locking profile complementary to the aforementioned unique locking profile.

6. The well according to claim 1 wherein the conveyor tube is designed to receive a well tool comprising one or more sensors which are designed to sense one or more well parameters.

7. The well according to claim 6, wherein at least one of the sensors is provided with a cable designed to bring about communication between at least one of the sensors and a surface control unit.

8. The well according to claim 1, wherein the conveyor tube is designed to convey and lock a well tool comprising one or more flow correctors.

9. The well according to claim 8, wherein the flow corrector consists of an essentially cylindrical element provided with a central through hole.

10. The well according to claim 8, wherein the flow corrector consists of an essentially cylindrical element which is provided with a central blind hole which is in fluid communication with a side hole, wherein the side hole corresponds to the fluid connection duct when a locking element of the flow corrector engages with a locking profile of the receiving unit, and wherein the holes are designed to maintain fluid communication between a section of the conveyor tube and the production tube.

11. A method for installing and replacing a well tool in a producing well having a production tube, wherein the well tool is fed into a conveyor tube which at least runs between a valve tree and at least one receiving unit in the well, wherein the at least one receiving unit is configured such that the well tool fed into the conveyor tube can be engaged into the at least one receiving unit, comprising the step of installing the conveyor tube on the outside of a production tube in the well such that at least a section of the conveyor tube runs between a valve tree provided at a top of the well and at least one receiving unit in the well.

12. The method according to claim 11, further comprising the step of pumping the well tool down through the conveyor tube.

13. The method according to claim 11, further comprising the step of conveying the well tool out of the conveyor tube under the influence of fluid pressure.

14. The method according to claim 11, further comprising the step of lowering the well tool down through the conveyor tube after fitting a pulling element between the well tool and an inlet end of the conveyor tube.

15. The method according to claim 11, whereby the well tool is conveyed out of the conveyor tube by applying a compressive force to the application of a pulling element fitted between the well tool and an inlet end of the conveyor tube.

16. The method according to claim 11, whereby the well tool is designed for selective engagement with one section of the conveyor tube.

17. A conveyor tube for use in installing or replacing a well tool in a producing well wherein the conveyor tube is installed on the outside of a production tube in a well, and wherein the well tool is fed into the conveyor tube, the conveyor tube comprising at least one receiving unit in the well, the at least one receiving unit being configured such that a well tool pumped into the conveyor tube can be engaged into the at least one receiving unit and at least a section of the conveyor tube runs between a valve tree and at least one receiving unit in the well, wherein the conveyor tube is designed to convey and lock a well tool comprising one or more flow correctors, and wherein the flow corrector consists of an essentially cylindrical element which is provided with a central blind hole which is in fluid communication with a side hole, wherein the side hole corresponds to the fluid connection duct when a locking element of the flow corrector engages with a locking profile of the receiving unit, and wherein the holes are designed to maintain fluid communication between a section of the conveyor tube and the production tube.

18. The conveyor tube according to claim 17, wherein the inside of the conveyor tube is in fluid communication with the inside of the production tube by means of at least one fluid connection duct fitted so that it connects to each of at least one receiving unit.

19. The conveyor tube according to claim 17, wherein the conveyor tube is designed to block the well tool from further movement in the conveyor tube when the well tool is in a predetermined position.

20. The conveyor tube according to claim 19, wherein the predetermined position is in at least one of the receiving units.

21. The conveyor tube according to claim 19, wherein each of the at least one of the receiving units is provided with a unique locking profile which is designed to receive a well tool with a locking profile complementary to the aforementioned unique locking profile.

22. The conveyor tube according to claim 17 wherein the conveyor tube is designed to receive a well tool comprising one or more sensors which are designed to sense one or more well parameters.

23. The conveyor tube according to claim 22, wherein at least one of the sensors is provided with a cable designed to bring about communication between at least one of the sensors and a surface control unit.

24. The conveyor tube according to claim 17, wherein the flow corrector consists of an essentially cylindrical element provided with a central through hole.

* * * * *